United States Patent [19]

Tsukamoto et al.

[11] 4,423,590

[45] Jan. 3, 1984

[54] BALLOON CONTROL RING

[75] Inventors: Kunio Tsukamoto; Michio Shibano, both of Kariya, Japan

[73] Assignee: Kabushiki Kaisha Toyoda Jidoshokki Seisakusho, Kariya, Japan

[21] Appl. No.: 289,904

[22] Filed: Aug. 4, 1981

[30] Foreign Application Priority Data

Aug. 9, 1980 [JP] Japan ..... 55-112903[U]

[51] Int. Cl.[3] ..... D01H 1/42

[52] U.S. Cl. ..... 57/354; 57/357

[58] Field of Search ..... 57/352, 354, 355, 357; 242/157 R

[56] References Cited

U.S. PATENT DOCUMENTS

| | | | |
|---|---|---|---|
| 2,745,239 | 5/1956 | Kingsbury | 57/354 |
| 2,994,491 | 8/1961 | Weber | 242/157 R X |
| 3,863,433 | 2/1975 | Kanai | 57/357 |

*Primary Examiner*—Donald Watkins

*Attorney, Agent, or Firm*—Brooks, Haidt, Haffner & Delahunty

[57] ABSTRACT

A balloon control ring to control ballooning phenomenon taking place in yarn being spun out from spinner or twister, wherein the inner circumferential surface thereof is formed with grooves provided therealong, yarn contacting surfaces located respectively above and below said grooves and bank portions so located as to divide adjacent ones of said grooves.

5 Claims, 4 Drawing Figures

BALLOON CONTROL RING

BACKGROUND OF THE INVENTION

The present invention relates generally to textile spinning or twisting machines, or specifically to an improvement of balloon control rings installed thereon.

The balloon control rings used heretofore on spinning or twisting machines to restrict the ballooning of yarn extending between the ring on the ring rail and the snail wire, to prevent excessive application of tension to such yarn, has presented various difficulties as machine speed has been increased in recent years. Namely, the spun-out yarn whose ballooning is to be controlled is pressed hard against the inner circumferential surface of the control ring, and the pressure due to such pressing becomes greater as the ballooning diameter of such yarn tends to become larger with an increase of machine speed. Accordingly, the resulting friction between the yarn and the inner circumferential surface of the balloon control ring is increased, thus offering increased resistance to the running and twisting of yarns. The balloon control rings in current general use accomplish control of ballooning merely by allowing the yarn to contact the inner circumferential surface of the ring, and it is known that the configuration of such inner circumferential surface will greatly influence the quality of finished yarns. When the balloon control ring has such configuration that the yarn's contacting length with respect to the inner circumferential surface of the ring is small, the effect of twisting in the direction of the snail wire is desirable, but the contacting pressure per given yarn length is increased so that excessive heat buildup takes place in the yarn due to increased friction between the yarn and the inner circumferential surface of the control ring. Furthermore, when processing synthetic yarns, they are susceptible to fusion by melting of the synethetic material due to excessive buildup of heat in such yarns. However, when the balloon control ring is so formed that the yarn's contacting length is greater so as to avoid the abovesaid melting, the contacting pressure per given yarn length may be reduced successfully, but an increase in the yarn's length which contacts the inner circumferential surface of the ring will discourage the twisting effect, inviting an increase in the production of lint and dust balls. Such inconveniences and defects become more acute with an increase of machine speed.

Because the above-mentioned disadvantages are derived from the strong pressure of contact the yarn against the inner circumferential surface of the balloon control ring, various designs of control rings have been proposed heretofore with a view to reducing as much as possible such contacting pressure. To name a few, these include Japanese Patent Publication 38-16963 (1963) of the present applicant which is so arranged as to separate the yarn from the inner circumferential surface of the balloon control ring by positively blowing air out from said surface of the control ring, and also a method in which the balloon control ring supports a rotary ring which is rotated positively by a flow of air, thereby allowing the yarn to contact said rotary ring in an attempt to successfully reduce the harmful friction caused when the yarn is turned in the balloon control ring. However, these proposals are disadvantageous in that they are complicated in construction, large in size, and furthermore costly to manufacture.

SUMMARY OF THE INVENTION

The object of the present invention is to provide, in view of the existence of air streams flowing with the yarn being turned in the balloon control ring, an improved version of a balloon control ring, according to which such air streams in said balloon control ring are guided in such a way that the yarn may be separated thereby from the inner circumferential surface of the balloon control ring for reducing the friction between the yarn and said inner circumferential surface.

DETAILED DESCRIPTION OF THE PREFERRED EMBODIMENT

Figure 1:
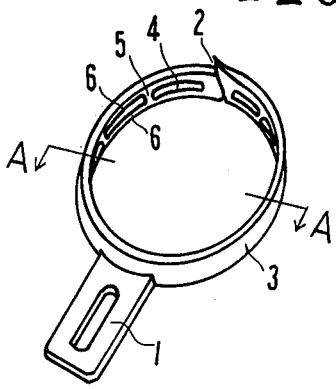
FIG. 1 shows a perspective view of a balloon control ring of the present invention.

Referring to the accompanying drawings, a balloon control ring 3 is shown which is formed into an annulus having a ring mounting 1 attached thereto and a threading slot 2 opened across the circumference of said ring 3. Though the balloon control ring 3 of the present invention looks similar to conventional ones externally, its inner circumference has an improved configuration which is described in detail hereafter. The improved balloon control ring 3 has a series of annularly elongated aligned grooves 4 separated from each other by respective bank portions 5 formed in the annular or circumferential direction of the ring centrally of the width of the inner circumferential surface of the ring, each bank portion 5 being so provided as to divide two adjacent said grooves 4. Said grooves 4 and bank portions 5 of the balloon control ring 3 are so formed that the inwardly facing surfaces of the bank portions 5 will not project further towards the center of the balloon ring than the two yarn contacting surfaces 6, 6 which project, respectively, adjacent to and along the upper and lower sides of each of their grooves 4.

In operation, as the yarn Y, which extends axially through the ring is turned along the inner circumferential surface of the balloon control ring 3 while being drawn in axial direction, the air streams which result from such turning of yarn Y are guided along said inner circumferential surface of the control ring 3 and also flow into the grooves 4. The air streams flowing in the grooves 4 are caused to be deflected outwardly therefrom by the bank portions 5 on the upstream sides of the grooves, thus flowing away from the yarn contacting surfaces 6, 6. Such deflection of the air streams taking place within the respective adjacent grooves 4 and bank portions 5 will result in the creation of air streams flowing away from the inner circumferential surface and inwardly of the balloon control ring, and therefore the yarn Y which is turned while contacting the yarn contacting surfaces 6, 6 is urged back by the air streams deflecting out of the grooves 4. Because the number of turns of the yarn Y being spun out is increased to as many as 230–273 in a second, the force of the air streams thus working on the yarn Y to urge it backwardly is fairly strong.

In this way, by providing the inner circumferential surface of balloon control ring 3 with grooves 4 and bank portions 5 alternately, and also with yarn contacting surfaces 6, 6 formed respectively above and below said grooves 4, the yarn Y contacts the separate surfaces 6, 6 with dispersed contacting pressure, and such contacting pressure of the yarn against the surfaces 6, 6 may be further reduced by the air streams acting to move the yarn Y away from the contacting surfaces 6, 6, with a result that the yarn twisting effect is improved, the tendency of lint formation is reduced, and the melting or fusion of synthetic yarns is successfully prevented. In addition, because the resistance acting on the running yarn is proportionately reduced, the productivity in spinning may be much improved.

Figure 2:
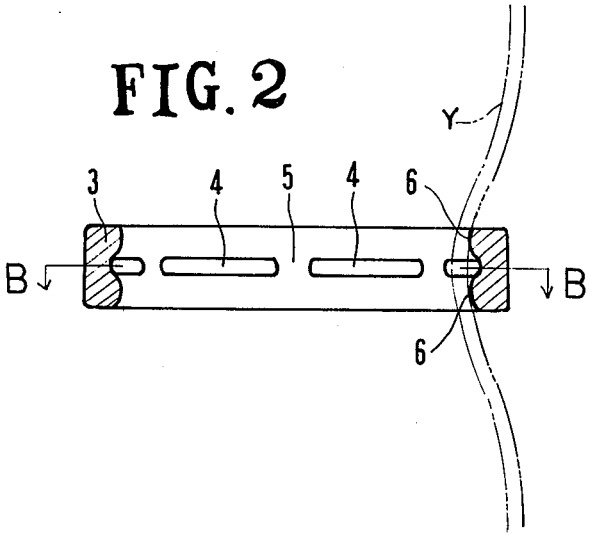
FIG. 2 shows, to an enlarged scale a vertical section taken along the line A—A of FIG. 1.
Figure 3:
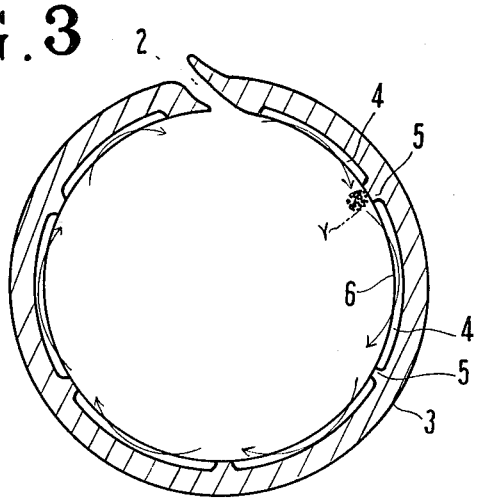
FIG. 3 shows a horizontal section taken along the line B—B of FIG. 2.
Figure 4:
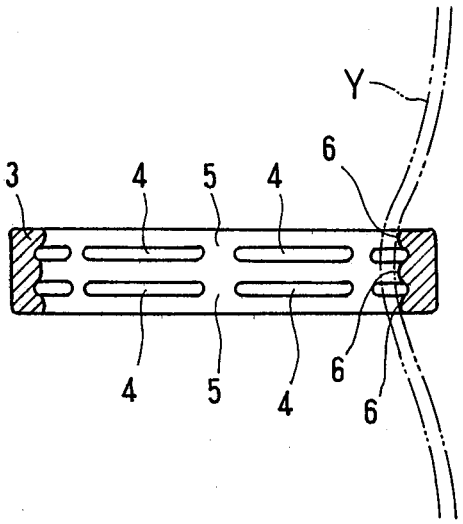
FIG. 4 is a vertical sectional view similar to FIG. 2 of a modified form of the invention.

Though the grooves 4 are provided only in a single annular extending series along the inner circumferential surface of the balloon control ring 3 according to the illustrated embodiment of FIGS. 1 and 2, it should be understood that the number of such annular series of grooves, as well as the number of annular yarn contacting surfaces 6, may be more as shown in the embodiment of FIG. 4.

As is apparent from the foregoing description, the balloon control ring 3 according to the present invention, in spite of its simplicity in construction, is capable of increasing yarn processing productivity without affecting yarn quality by utilizing the air streams created by the turning action of yarn in such a way that the friction between the yarn and the balloon control ring may be reduced, so that higher speeds of spinning or twisting can be successfully accomodated.

What is claimed is:

1. A balloon control ring to control ballooning of yarn being spun out from a spinner or twister, comprising an innner circumferential surface of said balloon control ring, means defining at least one annularly extending, aligned plurality of grooves formed in said inner circumferential surface, said inner circumferential surface defining annularly extending yarn contacting surfaces respectively above and below each said aligned plurality of grooves, and respective bank portions disposed between and forming the ends of adjacent one of said grooves, whereby air flowing within and along said grooves is diverted inwardly of said balloon ring by said bank portions.

2. A balloon control ring as set forth in claim 1, wherein said grooves are provided in a single line.

3. A balloon control ring as set forth in claim 1, wherein said means defines at least two annularly extending, aligned pluralities of grooves formed in said inner circumferential surface.

4. A balloon control ring as set forth in claim 1, wherein a plurality of said bank portions are provided.

5. A balloon ring according to claim 1, wherein each of said bank portions has an inwardly facing surface, said inwardly facing surfaces of said bank portions and said yarn contacting surfaces projecting inwardly of said balloon control ring to substantially the same extent.

* * * * *